US010766509B2

(12) United States Patent
Hubmann et al.

(10) Patent No.: US 10,766,509 B2
(45) Date of Patent: Sep. 8, 2020

(54) LONGITUDINAL SUPPORT AND TRANSVERSE SUPPORT FOR A CHASSIS FRAME OF A RAIL VEHICLE

(71) Applicant: SIEMENS AG ÖSTERREICH, Vienna (AT)

(72) Inventors: Markus Hubmann, Brodingberg (AT); Radovan Seifried, Maribor (SI)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 320 days.

(21) Appl. No.: 15/554,861

(22) PCT Filed: Feb. 18, 2016

(86) PCT No.: PCT/EP2016/053445
§ 371 (c)(1),
(2) Date: Aug. 31, 2017

(87) PCT Pub. No.: WO2016/139070
PCT Pub. Date: Sep. 9, 2016

(65) Prior Publication Data

US 2018/0043910 A1 Feb. 15, 2018

(30) Foreign Application Priority Data

Mar. 3, 2015 (AT) ..... A 50166/2015

(51) Int. Cl.
*B61F 5/52* (2006.01)
*B61F 5/26* (2006.01)

(52) U.S. Cl.
CPC . *B61F 5/52* (2013.01); *B61F 5/26* (2013.01)

(58) Field of Classification Search
CPC .... B61F 5/26; B61F 5/52; B61F 5/122; B61F 5/06; B61F 5/04; B61F 5/34
See application file for complete search history.

(56) References Cited

U.S. PATENT DOCUMENTS 1,661,833 A * 3/1928 Kadel ..... B61F 5/52 105/205
2004/0020400 A1* 2/2004 Cummings ..... B61D 3/12 105/4.1
2013/0213258 A1 8/2013 Chang

FOREIGN PATENT DOCUMENTS

CN 201 201 609 3/2009
CN 103 085 829 5/2013
CN 103 128 457 6/2013
(Continued)

*Primary Examiner* — Mark T Le
(74) *Attorney, Agent, or Firm* — Cozen O'Connor

(57) ABSTRACT

A longitudinal support and a transverse support for a chassis frame of a rail vehicle, wherein the longitudinal support includes a first box-shaped connection portion having a sectionally straight first circumferential edge for connection to the transverse support, where the transverse support has a second box-shaped connection portion having a sectionally straight second circumferential edge for connection to the longitudinal support within a transverse direction of the chassis frame, respectively on the end side, and where the first and second circumferential edges are each configured as four first and second connection edges to achieve a reduction of the weight of the longitudinal support and of the transverse support, and to lower the twisting rigidity of the chassis frame, where the connection edges are separated from each other by first and second recesses.

11 Claims, 3 Drawing Sheets

(56) References Cited

FOREIGN PATENT DOCUMENTS

| | | |
|---|---|---|
| CN | 203793356 | 8/2014 |
| EP | 2607211 | 6/2013 |
| JP | 2011 148400 | 8/2011 |

* cited by examiner

LONGITUDINAL SUPPORT AND TRANSVERSE SUPPORT FOR A CHASSIS FRAME OF A RAIL VEHICLE

CROSS-REFERENCE TO RELATED APPLICATIONS

This is a U.S. national stage of application No. PCT/EP2016/053445 filed 18 Feb. 2016. Priority is claimed on Austrian Application No. A50166/2015 filed Mar. 3, 2015 the content of which is incorporated herein by reference in its entirety.

FIELD OF THE INVENTION

The invention relates to a longitudinal support for a chassis frame of a rail vehicle, wherein in a central portion of the longitudinal support located centrally in relation to a longitudinal direction of the chassis frame, a box-shaped first connecting portion is provided, wherein for this purpose, the first connecting portion has an aperture with a partially straight first peripheral edge for the connection of a transverse support of the chassis frame and wherein the aperture opens the first connecting portion normal to the longitudinal direction in a transverse direction of the chassis frame, and a transverse support for a chassis frame of a rail vehicle, comprising a transverse support top flange, a transverse support bottom flange and two side walls connecting the transverse support top flange and the transverse support bottom flange, the transverse support having, relative to a transverse direction of the chassis frame, as seen from the end side, respectively a second box-shaped connecting portion, where the second connecting portion has a partially straight second peripheral edge for the connection of a longitudinal support of the chassis frame.

The invention also relates to chassis frames that are constructed from such longitudinal and transverse supports.

DESCRIPTION OF THE RELATED ART

Chassis, also known as wheel trucks, of rail vehicles typically have two wheelsets that are guided on rails and are connected to superstructures of the rail vehicle. An essential component of a chassis is a chassis frame to which the wheelsets are connected, for example, via a wheelset guide or a primary suspension and the superstructure, for example, via a secondary suspension and a device for force transmission. The force flows between the individual components extend thereby mainly via the chassis frames.

The chassis frame typically comprises two longitudinal supports that are oriented parallel to a longitudinal direction that corresponds to the direction of travel of the rail vehicle in the operating state, and one or more transverse supports that is oriented parallel to a transverse direction lying normal to the longitudinal direction, the embodiment with one transverse support being designated the H-construction form. Herein, the longitudinal supports can also be configured as frames closed by cap pieces.

The longitudinal supports have a central portion that is arranged, as seen in the longitudinal direction, in the center of the longitudinal support. Situated in this central portion, is a first box-shaped connecting portion for connection to the transverse support that has an aperture, where the aperture is open in the transverse direction, i.e., toward the transverse support. Typically, the longitudinal support is configured cranked, so that an end portion of the longitudinal support is oriented parallel to the central portion, where both portions are connected by a transition portion.

In the H-construction form, the transverse support is configured as a box-shaped profile and comprises a transverse support top flange, a transverse support bottom flange and two side walls that each consist of individual metal sheets or panel-shaped metal parts. Seen in a longitudinal direction of the transverse support that corresponds to the transverse direction of the chassis frame, the transverse support has a second connecting portion at each end for connection to one of the longitudinal supports.

Usually, the transverse support is loaded with all the main forces that are further conducted via the longitudinal supports into the wheelsets. The connection of the longitudinal supports to the transverse supports at the connecting portions is herein particularly highly loaded. In order to fulfill the functional requirements and also to provide the specified structural durability, the connection is typically massively constructed and is therefore very rigid. This rigid and massive design of the weld seams that are typically used for the connection is achieved with large weld seam lengths and large weld seam cross-sections to compensate for the low loadability of the weld seams. It is also known to use massive bulkhead plates that are arranged between the transverse support and the longitudinal support and are welded to both.

However, due to the high rigidity of the connection between the longitudinal support and the transverse support, the torsional stiffness of the chassis frame is also increased, i.e., an increased resistance to torsion about a transverse axis extending parallel to the transverse direction, which leads to a reduced derailing resistance, because the torsionally stiff chassis frame cannot compensate, for example, for different heights of the two rails. A further disadvantage of the prior art lies in the high manufacturing and material costs and in the high weight of the connection, caused by the above-described embodiment of the weld seams or mounting of bulkhead plates.

SUMMARY OF THE INVENTION

In view of the foregoing, it is therefore an object of the invention to overcome the disadvantages of the prior art and to provide a longitudinal support and a transverse support for a chassis frame which enable the use of high quality and therefore more highly loadable weld seams.

This and other objects and advantages are achieved in accordance with the invention by a transverse support and a longitudinal support for a chassis frame of a rail vehicle, where in a central portion of the longitudinal support located centrally in relation to a longitudinal direction of the chassis frame, a box-shaped first connecting portion is provided, where for this purpose, the first connecting portion has an aperture with a partially straight first peripheral edge for the connection of a transverse support of the chassis frame and where the aperture opens the first connecting portion normal to the longitudinal direction in a transverse direction of the chassis frame.

In accordance with the invention, the first peripheral edge is configured as four straight first connecting edges that are separated from one another by first recesses. In an inventive longitudinal support, the peripheral edge is made up of those edges which, seen in the transverse direction, form the outer delimitation of the first connecting portion, in other words, this relates to those edges lying in that plane normal to the transverse direction, which normal plane delimits the maximum extent of the first connecting portion in the transverse direction. With a subdivision of the peripheral edge into four connecting edges, high quality weld seams are producible between the inventive longitudinal support and any desired transverse support. The first recesses, which are preferably arranged at the corners of the box-shaped first connecting portion, prevent an abutting of two first connecting edges, because given a weld in this region, that is, on an abutting of two weld seams, stress concentrations would form. These stress concentrations are prevented by the recesses in the corner regions, so that the weld seams themselves must be configured for a lower loading. This results, with respect to the weld seam cross-sections, which can be reduced due to the lower loading, the necessary sheet metal thickness of the longitudinal support that can also be reduced due to the reduced weld seam cross-sections, the alignment effort which is also lessened as a result of the reduced weld lengths and cross-sections, in many positive effects which bring with them a reduction in the overall weight of the chassis frame and in the production costs.

In an embodiment of the invention, the longitudinal support comprises a longitudinal support top flange and a longitudinal support bottom flange, where in the first connecting portion, two side elements connecting the longitudinal support top flange and the longitudinal support bottom flange are arranged parallel to the transverse direction. The longitudinal support comprises, in any event, the longitudinal support top flange and the longitudinal support bottom flange. As a result, the first connecting portion can be manufactured easily if it comprises a portion of the longitudinal support top flange and the longitudinal support bottom flange and the box-shape is formed by two side elements. The side elements can be formed, for example, as bulges from side walls of the longitudinal support if the longitudinal support also has a box-shaped profile. However, it is herein also conceivable that the aperture is arranged directly in a side wall of the longitudinal support and thus the side elements are formed directly by the side wall itself.

If on the longitudinal support top flange an upper first connecting edge and on the longitudinal support bottom flange, a lower first connecting edge and on each of the side elements, a lateral first connecting edge is formed, then in a further embodiment of the invention, a particularly favorable shape of the first connecting edges and thus also of the weld seams is achievable if the first recesses are arranged at the imaginary intersection points of the first connecting edges.

In order to effectively prevent the mutual heat ingress from two weld seams produced at adjacent first connecting edges, in a further preferred embodiment of the invention, the first recesses overlap by between 5% and 30%, preferably between 8% and 25%, in particular between 10% and 20% of the periphery of a rectangle formed by the imaginary extensions of the first connecting edges. In that the first connecting edges are arranged on a box-shaped first connecting portion, the first connecting edges are arranged at the periphery of a rectangle. This rectangle therefore corresponds to that rectangle which arises from the imaginary extensions of the first connecting edges in the plane normal to the transverse direction. Due to the overlap of the rectangle by the first recesses, the overlap typically being distributed evenly over the individual first recesses, a minimum spacing is ensured between the first connecting edges. It is herein self-evident that the first recesses also extend in the transverse direction, where the extent of the first recesses in the transverse direction is greater than the overlapped region of the rectangle. Herein, in alternative embodiments of the invention, the first recesses in the region of the first connecting edges are narrowed, for example, by first rod-shaped portions for weld seam extension, and open, as seen in the transverse direction, behind the first connecting edges as far as a maximum extent normal to the transverse direction.

Fillet welds, i.e., weld seams with a triangular cross-section that are typically applied to a right-angled edge and are used, for example, according to the prior art for welding on bulkhead plates, withstand with the same quantity of weld material used, a lower loading than, for example, butt welds, i.e., weld seams that connect two blunt ends of metal sheets and in which the entire, for example, right-angular cross-section of the weld seam is configured covering the whole cross-section. Therefore, in a preferred embodiment of an inventive longitudinal support, the first connecting edges are configured such that a connection to the transverse support covering the whole cross-section can preferably be achieved by a butt weld. Apart from the increased load-carrying capacity of a connection covering the entire cross-section, such a connection can also be more easily processed, for example, ground level with the sheets, in order to improve the fatigue resistance of the weld seams. Connections configured in this way can also be tested with all known testing methods, for example, by penetration testing (PT), magnetic powder testing (MT), ultrasonic testing (UT) or radiation testing (RT).

The longitudinal support top flange and the longitudinal support bottom flange are more highly loaded by the forces to be introduced into the longitudinal supports than the side elements and also the processing of the side elements is often simpler. As a result, in a further embodiment of the invention, at least 70%, preferably at least 85% of the overall area of each of the first recesses lies on one of the side elements. The overall area of the first recess relates herein to that theoretical planar area that forms the first recess, which would be visible if the corresponding side element is folded by 90° into the plane of the longitudinal support top flange or the longitudinal support bottom flange, so that the side element and the longitudinal support top flange or the longitudinal support bottom flange form a common planar area.

For the reduction of the torsional stiffness of the longitudinal support and for the further reduction of the weight, in a particularly preferred embodiment of an inventive longitudinal support, it is provided that the longitudinal support is configured as an I-beam and the side elements are set, preferably welded, into the I-beam. The side elements are separately produced sheet metal parts that preferably span the entire space of the longitudinal support between the longitudinal support top flange, the longitudinal support bottom flange and a web. Side elements constructed in this way are herein preferably connected via weld seams to the elements of the longitudinal support.

A further reduction of the weight is herein achieved in a further embodiment in that the side elements have at least one side opening spaced from the first connecting portion.

It is also an object of the present invention to provide a transverse support for a chassis frame of a rail vehicle, comprising a transverse support top flange, a transverse support bottom flange and two side walls connecting the transverse support top flange and the transverse support bottom flange, where the transverse support has, relative to a transverse direction of the chassis frame, as seen from the end side, respectively a second box-shaped connecting portion, where the second connecting portion has a partially straight second peripheral edge for the connection of a longitudinal support of the chassis frame.

In accordance with the invention, the second peripheral edge is configured as four straight second connecting edges that are separated from one another by second recesses. In an inventive transverse support, the peripheral edge is made up of those edges which, as seen in the transverse direction, form the outer delimitation of the second connecting portion, in other words, this relates to those edges that lie in that plane normal to the transverse direction, which normal plane delimits the maximum extent of the second connecting portion in the transverse direction. With a subdivision of the peripheral edge into four connecting edges, high quality weld seams are producible between the inventive longitudinal support and any desired transverse support. The second recesses that are preferably arranged at the corners of the box-shaped second connecting portion, prevent an abutting of two second connecting edges, because in the case of a welding in this region, i.e., on an abutting of two weld seams, stress concentrations would form. This results, in an inventive transverse support, in the same advantages as previously described for the longitudinal support.

In an embodiment of an inventive transverse support, on the transverse support top flange an upper second connecting edge, on the transverse support bottom flange a lower second connecting edge and on each of the side walls, a lateral second connecting edge is formed, where the second recesses are arranged at the imaginary intersection points of the second connecting edges. With this, a particularly favorable and simply producible shape of the second connecting edges and thus also of the weld seams is achievable.

In order to effectively prevent the mutual heat ingress from two weld seams applied at adjacent second connecting edges, in a further preferred embodiment of the invention, the second recesses overlap by between 5% and 30%, preferably between 8% and 25%, in particular between 10% and 20% of the periphery of a rectangle formed by the imaginary extensions of the second connecting edges. In that the second connecting edges are arranged on a box-shaped second connecting portion, the second connecting edges are arranged at the periphery of a rectangle. This rectangle therefore corresponds to that rectangle which arises from the imaginary extensions of the second connecting edges in the plane normal to the transverse direction. Due to the overlap of the rectangle by the second recesses, where the overlaps typically are distributed evenly over the individual second recesses, a minimum spacing is ensured between the second connecting edges. It is herein self-evident that the second recesses also extend in the transverse direction in which the extent of the second recesses in the transverse direction is greater than the overlapped region of the rectangle. Herein, in alternative embodiments of the invention, the second recesses in the region of the second connecting edges are narrowed, for example, by second rod-shaped portions for weld seam extension, and open, as seen in the transverse direction, behind the second connecting edges as far as a maximum extent normal to the transverse direction.

Fillet welds, i.e., welds with a triangular cross-section typically have the aforementioned disadvantages. In a preferred embodiment of an inventive transverse support, the second connecting edges are consequently configured such that a connection to the longitudinal support covering the whole cross-section can preferably be achieved via a butt weld. Apart from the increased load-carrying capacity of a connection covering the whole cross-section, such a connection can also be more easily processed, for example, ground level with the sheets, in order to improve the fatigue resistance of the weld seams. Connections configured in this way can also be tested with all known testing methods.

Due to the simpler processing of the second connecting portions of the transverse support, compared with that of the longitudinal support, an approximately even distribution of the recess over two mutually adjacent elements of the transverse support, i.e., for example the transverse support top flange and the side wall, is possible. Therefore, in a further preferred embodiment of an inventive transverse support, between 35% and 60% of the overall area of each of the second recesses lies on one of the side walls, and the remainder of the overall area on the respective transverse support top flange or transverse support bottom flange. The overall area of the second recess relates herein to that planar area forming the second recess, which would be visible if the corresponding side wall is folded by 90° into the plane of the transverse support top flange or the transverse support bottom flange, so that the side wall and the transverse support top flange or the transverse support bottom flange form a common planar area.

In order to reduce the torsional stiffness of the transverse support and thus the torsional stiffness of the overall chassis frame, in a particularly preferred embodiment of the invention, the transverse support is configured as a bent part where, between the side walls and the transverse support top flange and between the side walls and the transverse support bottom flange, a bend region is formed in each case. Bent parts are manufactured in a bending process, also known as an edge bending process, in that by introducing a bending moment in a planar blank, by "unfolding" or "sheet metal" processing, the blank is plastically deformed and is thereby brought into a two-dimensional or three-dimensional form. Suitable manufacturing methods are, for example, swage bending or swivel bending. Those regions that are plastically deformed are designated bend regions and are characterized by a homogeneous and favorable stress flow.

The transverse support configured as a bent part, where the bent part can also be composed of a plurality of bent subparts, therefore has a particularly favorable stress flow, because in place of the edge between the transverse support top flange and the side wall, which in the prior art is joined via a weld seam, the bend region connects the transverse support top flange and the first side wall. A similar principle applies accordingly for the connection of the transverse support top flange and the second side wall and the transverse support bottom flange and the first and second side wall. The bend regions relate to the respective plastically deformed, preferably curved, regions of the transverse support. With the favorable stress flow, firstly, the thickness of the sheet metal from which the transverse support is produced can be reduced and, secondly, no fillet welds are needed for connection, so that in comparison with the prior art, both weight is saved and also the torsional stiffness is reduced.

In a further particularly preferred embodiment of the invention, the transverse support has a flange aperture at least at the transverse support top flange and at the transverse support bottom flange, where at least one of the flange apertures occupies at least 50% of the area of the transverse support top flange or the transverse support bottom flange. With the relatively large flange aperture, the torsional stiffness of the transverse support is still further reduced to achieve a greatly improved derailing resistance of the rail vehicle.

It is also an object of the invention to provide a chassis frame for a rail vehicle with two inventive longitudinal supports and an inventive transverse support connecting the two longitudinal supports, where each of the two connecting portions of the transverse support is connected to a first connecting portion of a longitudinal support. In one embodiment of the inventive chassis frame, the first connecting edges of the longitudinal supports are therefore connected to the respective second connecting edges of the transverse support via a weld seam. With the above-described configuration of the connecting edges, with the combination of an inventive transverse support with two inventive longitudinal supports, a series of advantageous effects are created.

That is, the connecting edges extending straight and the recesses arranged therebetween permit a connection of the first connecting portions to the second connecting portions with weld seams which extend exclusively straight and do not influence one another negatively by heat ingress.

With the formation of the weld seams as connections covering the entire cross-section, preferably as butt welds, both weld seam cross-section and also weld seam length, as well as sheet metal thickness of the transverse support and at least the first connecting portion of the longitudinal support can be reduced.

If the longitudinal supports are configured as I-beams and the transverse support is configured as a bent part, then there a chassis frame with low torsional stiffness and, thus, a high derailing resistance is achieved.

If a flange aperture is provided in the transverse support top flange or in the transverse support bottom flange that occupies at least 50% of the area of the transverse support top flange or of the transverse support bottom flange, then this flange aperture can be used as an access aperture for processing operations. Thus, the weld seams can be counterwelded between the connecting edges and aftertreated on both sides, for example, ground. Thus, firstly, the problem of corrosion is solved so that the flange opening does not have to be closed. Secondly, through the aftertreatment and counterwelding of the weld seams, the fatigue resistance is greatly increased. Additionally, a repair of the weld seams on the chassis frame is possible or involves significantly less effort than in chassis frames of this type.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

For further explanation of the invention, reference will be made in the following section of the description to the drawings which illustrate further advantageous embodiments, details and developments of the invention. The figures are to be regarded as exemplary and are intended to illustrate the character of the invention, but do not in any way restrict it or represent it conclusively, in which.

DETAILED DESCRIPTION OF THE EXEMPLARY EMBODIMENTS

Figure 1:
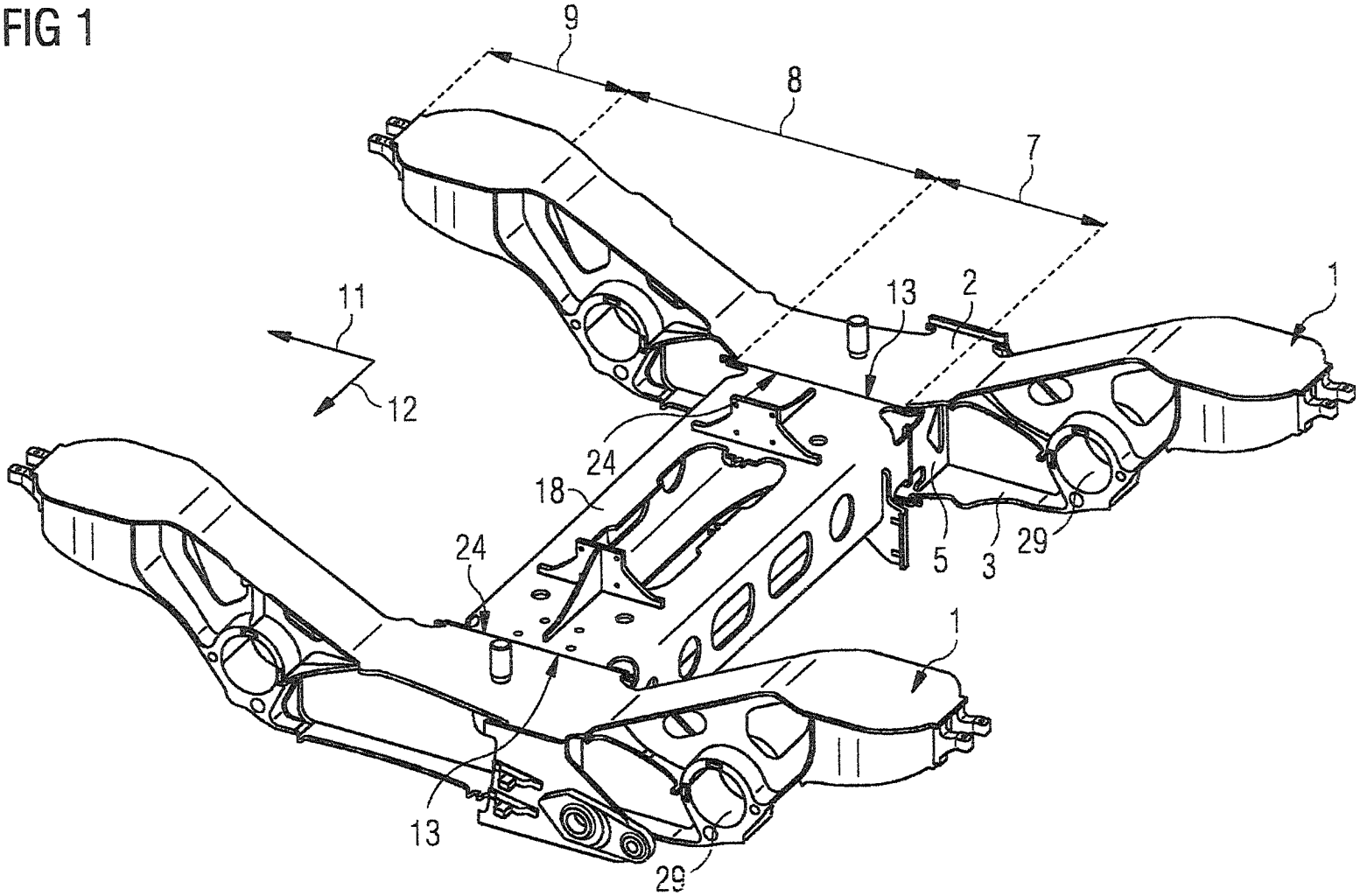
FIG. 1 is an axonometric view of a chassis frame in accordance with the invention.

FIG. 1 shows a three-dimensional representation of an embodiment of an inventive chassis frame for a rail vehicle. This comprises herein two longitudinal supports 1 that are oriented parallel to a longitudinal direction 11, and a transverse support 18 connecting the two longitudinal supports 1, which is oriented parallel to a transverse direction 12 arranged normal to the longitudinal direction 11. The longitudinal direction 11 herein corresponds to the direction of travel of the rail vehicle in the operating state.

Figure 2:
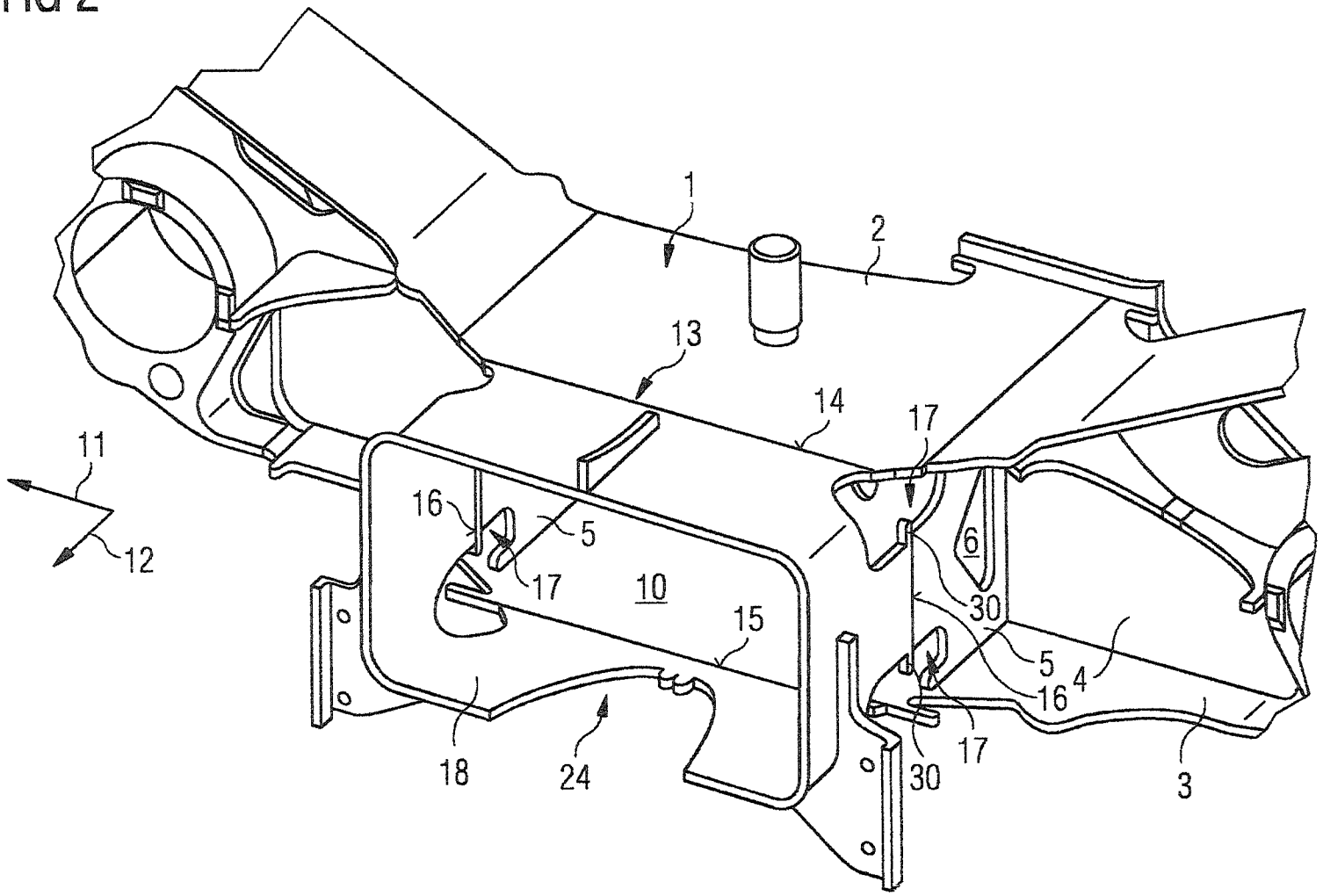
FIG. 2 is a detailed view of the connection between the longitudinal support and the transverse support in accordance with the invention.

The longitudinal supports 1 are herein configured as I-beams and thus have a longitudinal support top flange 2, a longitudinal support bottom flange 3 and a web 4 connecting both symmetrically (see FIG. 2). A cranked form of the longitudinal support 1 is provided in that it has a central portion 7 and, in the longitudinal direction 11, respectively in front of and behind the central portion 7, an end portion 9 parallel to the central portion 7, where the portions 7, 9 are connected by a transition portion 8 extending obliquely. In the central portion 7 of the longitudinal support 1, the longitudinal support top flange 2 and the longitudinal support bottom flange 3 extend parallel to one another. The connection between the transverse support 18 and the longitudinal support 1 occurs, in the case of the longitudinal support 1, via a first box-shaped connecting portion 13 arranged in the central portion 7. The first connecting portion 13 is herein formed by the longitudinal support top flange 2, the longitudinal support bottom flange 3 and two side elements 5 and opens in the transverse direction 12 toward the transverse support 18.

For connection of the chassis frame to a wheelset guide, each longitudinal support 1 has two wheelset guide bushings 29 that have a circular cross-section and serve to receive a pin of the wheelset guide. The longitudinal axes of the wheelset guide bushings 29 are herein oriented parallel to the transverse direction 12.

In the present exemplary embodiment, the transverse support 18 is configured as a single-piece box-shaped bent part that in each case forms, as seen in the transverse direction 12, a second box-shaped connecting portion 24. The second connecting portions 24 of the transverse support 18 are herein each connected via weld seams, in particular butt welds, to the respective first connecting portion 13 of a longitudinal support 1.

FIG. 2 shows an enlarged detail view of the first connecting portion 13, where a part of the second connecting portion 24 of the transverse support 18 is also shown. For the sake of clarity, however, in this figure only the relevant parts of the first connecting portion 13 are shown, whilst for the second connecting portion 24, reference is made to FIG. 3. It is herein clearly shown that the side elements 5 are oriented substantially parallel to the transverse direction 12 and are connected to the longitudinal support top flange 2, the longitudinal support bottom flange 3 and the web 4 via weld seams (not shown). Here, the side elements 5 have a side aperture 6 in the region of the web 4, spaced from the web that has the form of a triangle with rounded edges, where the longest edge of the triangle extends parallel to the web 4. Here, an aperture 10 of the first connecting portion 13, which is formed by the longitudinal support top flange 2, the longitudinal support bottom flange 3 and the side elements 5, opens the first connecting portion 13 in the transverse direction 12.

A peripheral edge of the first connecting portion 13, i.e., that edge that lies in a plane normal to the transverse direction 12 and contacts the transverse support 18 is made from four first connecting edges 14, 15, 16: an upper first connecting edge 14 that is formed by the longitudinal support top flange 2, a lower first connecting edge 15 that is formed by the longitudinal support bottom flange 3 and two lateral first connecting edges 16, each formed by one of the side elements 5. The first connecting edges 14, 15, 16 are herein separated from one another by first recesses 17, so that the first connecting edges 14, 15, 16 extend exclusively straight and do not touch one another. The first recesses 17 are arranged at the imaginary intersection points of the extensions of the first connecting edges 14, 15, 16, i.e. is at the corners of an imaginary rectangle on which the first connecting edges 14, 15, 16 lie.

In relation to the periphery of the imaginary rectangle, the first recesses 17 herein overlap approximately 17.5% of the periphery. The first recesses 17 also extend in the transverse direction 12, an essentially U-shaped form being produced in the side elements 5, making up approximately 80% of the overall area of the first recess 17. In the region of the first connecting edges 14, 15, 16, the recess 17 is narrowed because, to extend the first lateral connecting edge 16 and the weld seam applied thereto, the side elements 5 have first rod-shaped portions 30 that are oriented in the direction of the longitudinal support top flange 2 or the longitudinal support bottom flange 3 or parallel to a height direction, normal to the longitudinal direction 11 and the transverse direction 12. Behind the first rod-shaped portions 30, as seen in the transverse direction 12, the first recess 17 is enlarged in the height direction so that the first rod-shaped portions 30 arise via an undercut of the first lateral connecting edge 16. Similarly thereto, it is naturally also conceivable that the upper first connecting edge 14 or the lower first connecting edge 15 also form a further first rod-shaped portion for extending the weld seams that are oriented parallel to the longitudinal direction 11.

Figure 3:
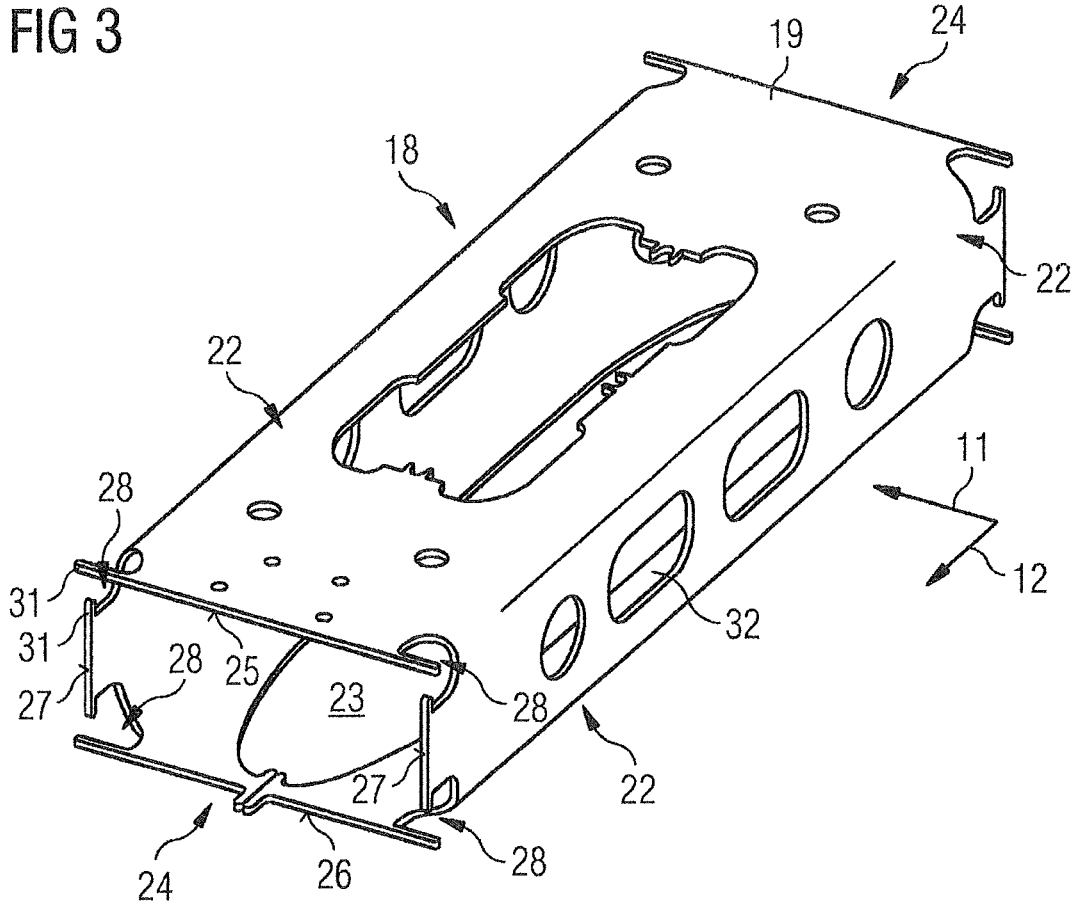
FIG. 3 is an axonometric view of a transverse support in accordance with the invention.

FIG. 3 shows a transverse support 18 with a box-shaped profile, where the cross-section is normal to the transverse direction 12. The transverse support comprises a transverse support top flange 19, which in the installed state, faces toward a superstructure of a rail vehicle, a transverse support bottom flange 20 which in the installed state faces toward the rails and two side walls 21 which form the left and right sides of the transverse support. Seen in the transverse direction 12, the transverse support 18 has at each end, i.e., at the front and rear ends, a second connecting portion 24. These second connecting portions 24 serve to connect each transverse support 18 to a longitudinal support 1. This relates, in the case of the second connecting portions 24 in the present example, to the open ends of the box-shaped transverse support 18.

In order to achieve a favorable stress flow in the transverse support, the transverse support 18 is configured as a bent part, in the present case as a single piece bent part. With a corresponding manufacturing process, for example, edge bending, swivel bending or swage bending, the box-shaped profile of the transverse support 18 is produced from a flat blank in that via an introduced bending moment, the blank is plastically deformed locally so that a three-dimensional form develops from the substantially two-dimensional blank. The following positive effect arises from such a manufacturing method. That is, the bent part is a single part, which forms both the transverse support top flange 19, the transverse support bottom flange 20 and also the side walls 21. Consequently, only a single connecting weld seam is required to produce the box profile. This connecting weld seam is herein preferably arranged outside the bend regions 22, for example, the weld seam extends parallel to the transverse direction 12 in the center of the transverse support bottom flange 20.

In accordance with the invention, the transverse support top flange 19 is constructed such that a bend region 22 forms at the transition between the transverse support top flange 19 and the right side wall 21 in that region which was plastically deformed during the manufacturing process. The bend region 22 herein represents a curved region, which in the present example, is configured as a transition radius with a bending radius. Here, the bending radius relates to a circular radius, that which in alternative embodiments, curves with different curvature, for example, ellipses are also conceivable. Equally, between the transverse support top flange 19 and the left side wall 21, a bend region 22 is formed. Entirely similarly, at the transition between the side walls 21 and the transverse support bottom flange 20, bend regions 22 of the same shape are formed, so that the cross-section of the transverse support has the form, normal to the transverse direction 12 of a right angle with rounded corners.

A peripheral edge of the second connecting portion i.e., that is, that edge which lies in a normal plane to the transverse direction 12 and contacts the longitudinal support 1 is composed from four second connecting edges 25, 26, 27: an upper second connecting edge 25 that is formed from the longitudinal support top flange 19, a lower second connecting edge 26 that is formed by the transverse support bottom flange 20 and two lateral second connecting edges 27, each formed by one of the side walls 21. The second connecting edges 25, 26, 27 are herein separated from one another by second recesses 28, so that the second connecting edges 25, 26, 27, like the first connecting edges 14, 15, 16 extend exclusively straight and do not touch one another. The second recesses 28 are arranged at the imaginary intersection points of the extensions of the second connecting edges 25, 26, 27, i.e., at the corners of an imaginary rectangle on which the second connecting edges 25, 26, 27 lie.

In relation to the periphery of the imaginary rectangle, the second recesses 28 herein overlap approximately 17.5% of the periphery. The second recesses 28 also extend in the transverse direction 12, starting from the second connecting edges 25, 26, 27 in the direction of the center of the transverse support 18. If a theoretical state is now considered in which the transverse support top flange 19 and the side walls 21 form a planar area, i.e., the theoretical state in which the side walls 21 are folded out by 90° in the direction of the transverse support top flange 19, then the upper second connecting edge 25 and the lateral second connecting edges 27 are oriented along a width direction parallel to the transverse direction 12. In this theoretical state, the second recesses 28 form a semicircular shape, which extends in the width direction at least over the bend region 22. The second recesses 28 are herein divided approximately in equal parts into the transverse support top flange 19 or the transverse support bottom flange 20 and the respective side wall 21. The second recesses 28 in the region of the second connecting edges 25, 26, 27 are constricted. As a result, second rod-shaped portions 31 thus form that serve as an extension of the second connecting edges 25, 26, 27 or the weld seams applied thereto. The second rod-shaped portions 31 herein form an inner edge of the semicircular region of the second recesses 28. A similar principle therefore naturally also applies for a second theoretical state in which the side walls 21 are folded in the other direction and form a planar area together with the transverse support bottom flange 20.

Returning to FIG. 2, with respect to the first and second recesses 17, 28, it becomes clear that the first and second recesses 17, 28 form a common recess, the edges of which give way to one another wherein the first and second rod-shaped portions 30, 31 extend into the common recess.

It is also clear in FIG. 3 that the transverse support top flange 19 has a flange aperture 23 that has a substantially rectangular shape wherein roundings and constrictions in the form are provided. The flange aperture 23 is oriented symmetrically to the transverse support top flange 19 both in the longitudinal direction 11 and in the transverse direction 12 and therein occupies approximately 30% of the area of the transverse support top flange 19. The transverse support bottom flange 20 also has a flange aperture 23 that is oriented symmetrically to the transverse support bottom flange 20 both in the longitudinal direction 11 and in the transverse direction 12. However, this flange aperture 23 is elliptically configured and occupies approximately 75% of the area of the transverse support bottom flange 20, so that the transverse support bottom flange 20 has a lower shearing rigidity and torsional stiffness than the transverse support top flange 19. Four further flange apertures 32 are also arranged on each of the side walls 21.

In particular, the flange aperture 23 of the transverse support bottom flange 20 herein serves as an access aperture for processing because, by means thereof, the weld seams that join the first connecting edges 14, 15, 16 and the second connecting edges 25, 26, 27 to one another preferably via butt welds covering the entire cross-section, both counter-welding can be performed on both sides, as well as suitable afterprocessing, for example grinding level with the sheet metal on both sides of the weld seam.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A longitudinal support for a chassis frame of a rail vehicle, comprising:

a box-shaped first connecting portion disposed in a central portion of the longitudinal support such that said box-shaped first connecting portion is located centrally in relation to a longitudinal direction of the chassis frame, the first connecting portion having an aperture with a partially straight first peripheral edge for connection of a transverse support of the chassis frame, said aperture opening the first connecting portion normal to the longitudinal direction in a transverse direction of the chassis frame;

wherein the first peripheral edge is configured as four first connecting edges extending straight, said first connecting edges being separated from one another by first recesses, an upper first connecting edge of the four first connecting edges being formed by a top flange of the longitudinal support and a lower first connecting edge of the four first connecting edges being formed by a bottom flange of the longitudinal support.

2. The longitudinal support as claimed in claim 1, wherein the longitudinal support comprises a longitudinal support top flange and a longitudinal support bottom flange; and wherein two side elements connecting the longitudinal support top flange and the longitudinal support bottom flange are arranged parallel to the transverse direction within the first connecting portion.

3. The longitudinal support as claimed in claim 2, wherein a lateral first connecting edge is formed on (i) the longitudinal support top flange, (ii) an upper first connecting edge, (iii) the longitudinal support bottom flange, (iv) a lower first connecting edge and (v) on each of the side elements; and wherein the first recesses are arranged at an imaginary intersection points of the first connecting edges.

4. The longitudinal support as claimed in claim 1, wherein the first recesses overlap by between 5% and 30% of the periphery of a rectangle formed by imaginary extensions of the first connecting edges.

5. The longitudinal support as claimed in claim 1, wherein the first connecting edges are configured such that a connection to the transverse support covering an entire cross-section is achievable via a butt weld.

6. The longitudinal support as claimed in claim 2, wherein at least 70% an overall area of each of the first recesses lies on one of the two side elements.

7. The longitudinal support as claimed in claim 2, wherein the longitudinal support is configured as an I-beam and the two side elements are inserted into the I-beam via welding.

8. The longitudinal support as claimed in claim 7, wherein the two side elements have at least one side aperture (6) spaced from the first connecting portion.

9. The longitudinal support as claimed in claim 4, wherein the first recesses overlap by between 8% and 25% of the periphery of a rectangle formed by the imaginary extensions of the first connecting edges.

10. The longitudinal support as claimed in claim 9, wherein the first recesses overlap by 10% and 20% of the periphery of the rectangle formed by the imaginary extensions of the first connecting edges.

11. The longitudinal support as claimed in claim 6, wherein at least 85% of the overall area of each of the first recesses lies on one of the two side elements.

* * * * *